United States Patent [19]

Dain

[11] 4,244,420

[45] Jan. 13, 1981

[54] APPARATUS FOR FEEDING A HORIZONTAL CONTINUOUS CASTING MOLD

[75] Inventor: Richard J. Dain, Crouch, Near Borough Green, England

[73] Assignee: Davy-Loewy Limited, Sheffield, England

[21] Appl. No.: 907,016

[22] Filed: May 17, 1978

Related U.S. Application Data

[63] Continuation of Ser. No. 741,453, Nov. 12, 1976, abandoned, which is a continuation of Ser. No. 578,917, May 19, 1975, abandoned.

[51] Int. Cl.[2] ..... B22D 11/10

[52] U.S. Cl. ..... 164/440; 164/82; 164/443

[58] Field of Search ..... 164/82, 85, 421, 439, 164/440, 443

[56] References Cited

U.S. PATENT DOCUMENTS

| | | | |
|---|---|---|---|
| 2,466,612 | 4/1949 | Phillips et al. | 164/85 X |
| 3,477,494 | 11/1969 | Burkart et al. | 164/418 |
| 3,578,065 | 5/1971 | Langer | 164/85 X |
| 3,587,718 | 6/1971 | Hopkins | 164/82 X |
| 3,905,418 | 9/1975 | Watts | 164/260 |
| 4,000,773 | 1/1977 | Sevastakis | 164/421 |

FOREIGN PATENT DOCUMENTS

| | | | |
|---|---|---|---|
| 1104124 | 4/1961 | Fed. Rep. of Germany | 164/440 |
| 1811295 | 6/1969 | Fed. Rep. of Germany | 164/440 |
| 2013290 | 10/1970 | Fed. Rep. of Germany | 164/440 |

*Primary Examiner*—Robert D. Baldwin
*Assistant Examiner*—Gus T. Hampilos
*Attorney, Agent, or Firm*—Brisebois & Kruger

[57] ABSTRACT

A combined feed tube and continuous casting mould comprises a copper mould having a refractory feed tube projecting into the inlet end of the mould passage. The feed tube is in abutting relation with the wall of the mould passage and the material from which the feed tube is formed is one which has a low coefficient of friction such as graphite. The portion of the feed tube in the mould provides the surface on which the initial freezing of the molten metal occurs and this surface is cooled by its contact with the mould.

6 Claims, 3 Drawing Figures

APPARATUS FOR FEEDING A HORIZONTAL CONTINUOUS CASTING MOLD

Figure 1:
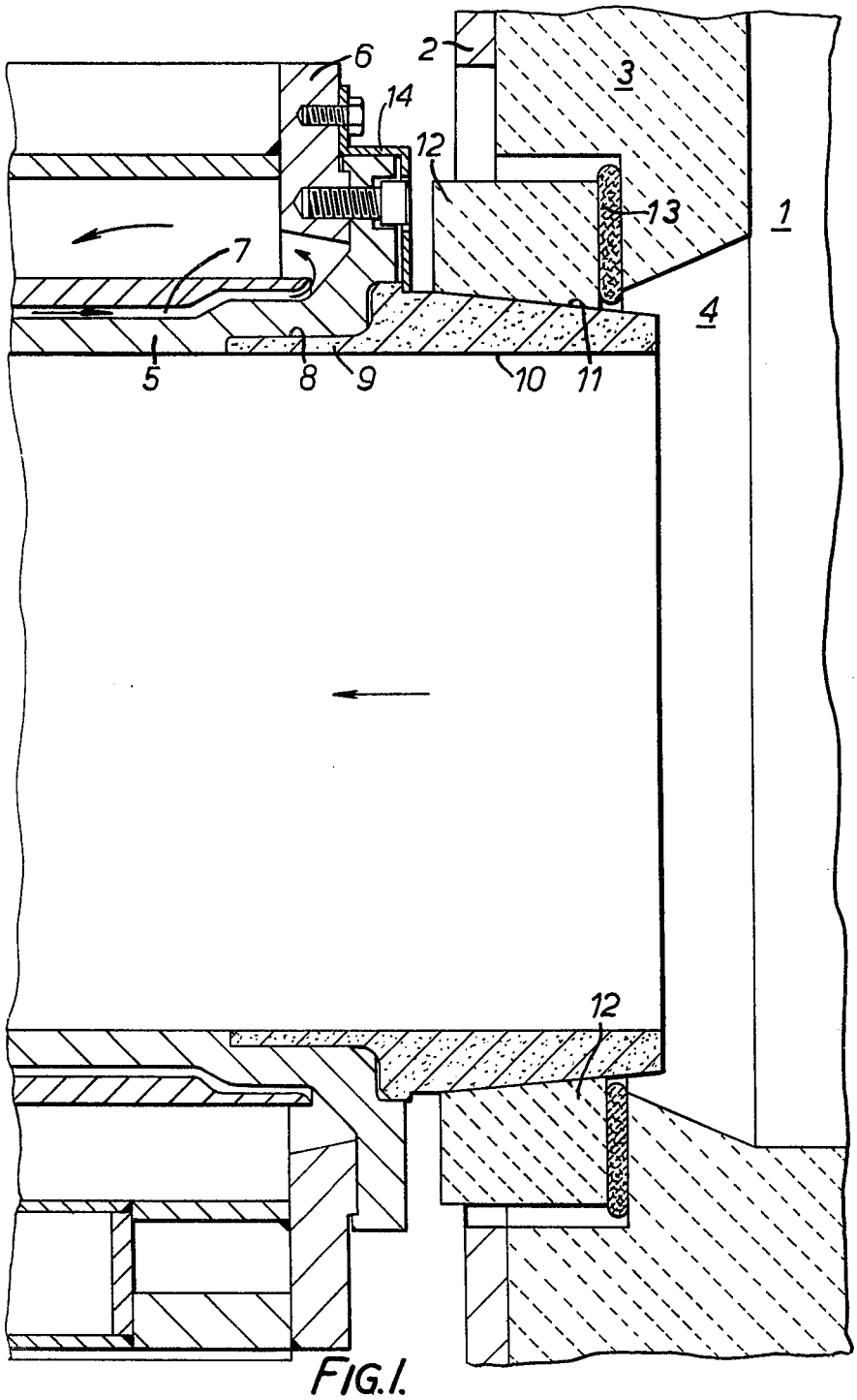

This is a continuation of Ser. No. 741,453, filed Nov. 12, 1976, (now abandoned) which was a continuation of Ser. No. 578,917, filed May 19, 1975 (now abandoned).

This invention relates to the combination of a mould and a feed tube suitable for use in the continuous casting of metal.

In a continuous casting process, as the metal is transferred from its molten state to a finished cold product it goes through four distinct zones of cooling. In the first zone the metal loses super heat in a feed tube or nozzle conveying it to the mould inlet. A thin pliable layer of frozen metal which conforms to the mould shape and remains substantially in contact with the mould is formed at the second zone of cooling which is situated at or near the inlet end of the mould. The third zone of cooling develops the frozen skin of the product to sufficient thickness to resist the pressure developed by the head of metal and causes contraction of the casting away from the mould wall. This zone of cooling is provided by that part of the mould which is other than that comprising the first and second zones. Finally the casting is cooled in the fourth zone by direct impingement of cooling medium such as water or air.

At the second zone of cooling the newly frozen skin of the casting is very thin and steps have to be taken to prevent this skin from being torn as the casting moves through the mould.

The invention resides in providing the second zone of cooling by a feed tube of refractory material which also provides the first zone of cooling, the feed tube being in abutting relation with the wall of the mould whereby the feed tube is in heat transfer relation with the mould wall.

A disadvantage of a mould of high thermal conductivity is that the mould may become distorted at its inlet end. Hot metal enters the mould at the beginning of the cast and rapidly heats the inner mould wall while the outer wall is still cold. The inner wall metal expands and loses some of its strength with increased temperature and then undergoes compressive failure under the restraining force of the still cold outer part of the mould wall. At the end of the cast the reverse procedure occurs and this causes distortion of the mould by the reduction in diameter of the mould passage. The type of distortion is known as the "wine glass" effect.

The mould of the combination of the present invention does not suffer from the "wine glass" effect because the mould wall at the inlet end of the mould is protected by the refractory material which projects into the mould passage. The refractory material where it projects into the mould passage constitutes a second zone of cooling and it allows sliding of the newly frozen material over its surface with little drag or friction so that this part of the tube which is cooled by its contact with the mould of high thermal conductivity forms an ideal second zone of cooling.

In order that the invention may be more readily understood it will now be described, by way of example only, with reference to the accompanying drawings, in which:-

Figure 2:
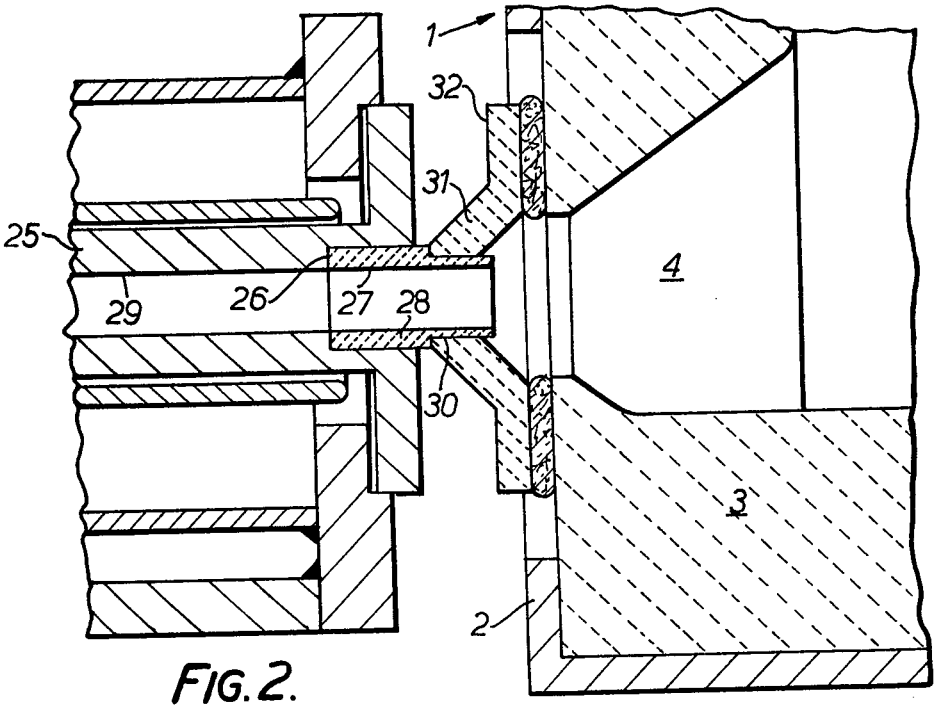
Figure 3:
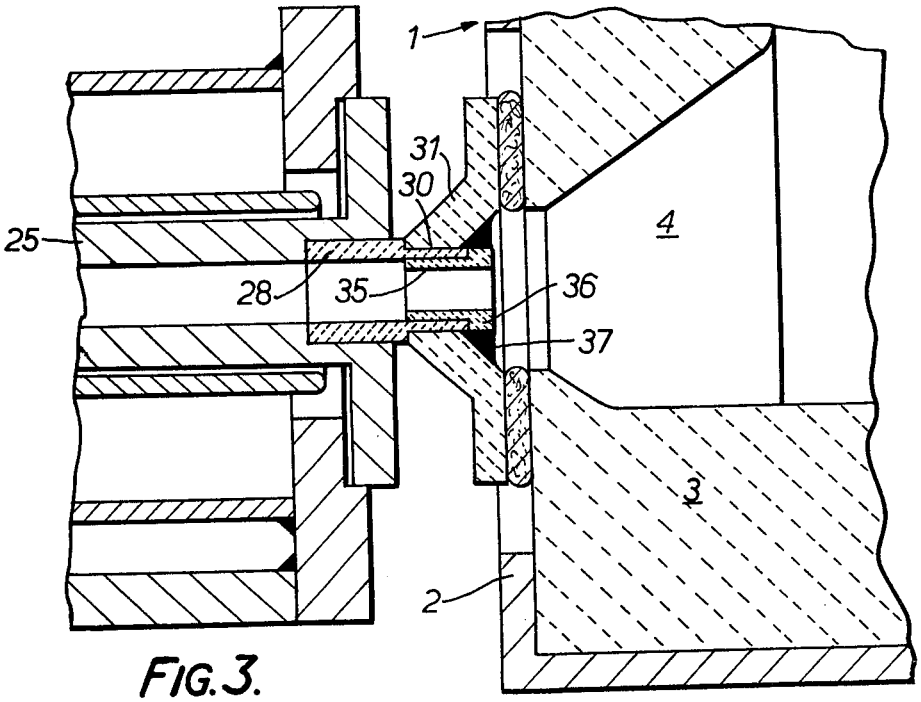

FIG. 1 is a sectional side elevation of a continuous casting mould and feed tube arrangement, FIG. 2 is a sectional side elevation of a mould and feed tube arrangement according to a second embodiment of the invention, and FIG. 3 is a side elevation similar to FIG. 2 but showing a modification thereof.

Referring to FIG. 1, a tundish 1 for storing molten metal to be cast comprises a metal container 2 having a lining of refractory bricks 3. There is an opening in the wall of the casing and a similar opening 4 in the refractory bricks. This opening constitutes the outlet from the tundish.

A continuous casting mould arranged with its longitudinal axis horizontal is positioned adjacent the opening 3 and comprises a copper body 5 in the form of a tube which is surrounded by a jacket 6 with a space 7 between the tube and the jacket. When the mould is in use a cooling liquid, usually water, is passed through the space 7 in order to cool the mould. The bore of the tube 5 constitutes the mould passage and at the inlet end of the mould passage there is a recessed portion 8 which receives an end portion 9, in the form of a sleeve, of a feed tube 10 made from a low friction coefficient refractory material. The outer lengthwise surface of the sleeve 9 abuts against the wall of the tube 5 so as to be in good thermal contact therewith and the sleeve is cooled to a lower temperature than that part of the tube which is located outside the mould. The part of the tube 10 which is outside the mould is tapered on its outer surface 11 and projects into the opening 4 in the tundish. An annular member 12 of refractory material, such as 37% alumina, has a tapered bore and the member 12 fits over the tapered surface 11 and is sealed thereto with a refractory cement which may be alcohol based. The joint between the member 12 and the front brick 3 of the tundish is sealed by means of a refractory cement or an air setting plastic refractory compound 13. The tube 10 is fastened to the mould by an apertured plate 14 which fits over the tube 10 and is bolted to the adjacent end of the mould.

When the metal to be cast is copper, the tube 10 and consequently the sleeve 9 are of graphite. The sleeve 9 constitutes the second zone of cooling for molten metal supplied to the inlet end of the mould, the first zone being constituted by the feed tube 10. At the second zone of cooling a thin skin of metal is formed on the sleeve 9 and consistently breaks away therefrom. As the sleeve 9 is positioned between the molten metal and the tube 5 at the inlet end of the mould, distortion of the mould is considerably reduced.

In the arrangement shown in FIG. 2, the inlet end of the mould tube 25 is recessed at 26 to receive an end portion 27 of a tubular graphite feed tube 28. The wall of the bore of the tube is substantially flush with the surface 29 of the mould passage and the portion 27 of the feed tube is in good heat transfer relation with the mould. The end of the feed tube which is away from the mould is of reduced cross-section and fits into an opening 30 in a fireclay body 31 of hollow frusto-conical form. The base portion 32 of this body is sealed by a refractory cement to the front brick 3 of a tundish 1. When the apparatus is in use the feed tube 28 provides both the first and second zones of cooling.

The refractory feed tube of the arrangement is conveniently of graphite but it has been found that the graphite, particularly at the inlet end of the feed tube, becomes eroded during the casting operation and it is advantageous for the graphite to be protected at least at the inlet end of the tube.

Referring to FIG. 3, the end of the feed tube 28 which is away from the mould is of reduced cross-section and fits into an opening 30 in a fireclay body 31. The end of the graphite feed tube 28 close to the tundish is likely to be chemically eroded by the molten metal when the apparatus is in use and this end and the bore of the tube is protected from the molten metal by a layer 35 of a refractory material which has the greater resistance to chemical erosion by the molten metal than does graphite.

The layer is conveniently in the form of a sleeve extending into, and part way along, the bore of the tube from a body 36 of the refractory material secured to the end of the feed tube by a mass of refractory cement 37. The refractory material is conveniently silicon nitride, silicon carbide or Sillimanite which is a mixture of alumina and silica.

I claim:

1. In combination, a continuous casting mould including a copper body defining an open ended mould cavity extending through the copper body between inlet and outlet ends thereof, the cross-sectional dimensions of the cavity being uniform along its length apart from a portion at the inlet end thereof which has enlarged cross-sectional dimensions as compared with the remainder of the cavity, means for cooling said mould adjacent said inlet, a one piece graphite feed tube defining a bore which has the same cross-sectional dimensions as said remainder of the cavity, a first end portion of the tube having external cross-sectional dimensions which are the same as those of the enlarged portion at the inlet end of the cavity, said first end portion of the tube projecting into said enlarged portion of the cavity with the outer surface of said first end portion abutting against surfaces of the body defining the enlarged portion in good heat transfer relationship therewith, and means for supplying molten metal to said feed tube and comprising a tundish including a side wall having an outlet opening therein, said tube having a second end portion, including an end wall projecting into said outlet opening and having a surface sealed to the wall of the tundish defining said outlet opening, and wherein the end wall of said second end portion and a portion of the tube defining the bore of said second end portion, and extending from the end wall of said second end portion of the tube a distance less than the entire length of the bore of the feed tube, are covered by a body of refractory material other than graphite.

2. The combination claimed in claim 1 in which the first end portion of the tube is of reduced wall thickness as compared with the wall thickness of the remainder of the tube.

3. The combination claimed in claim 1 comprising fastening means screwed to the mould and engaging the feed tube to fasten the tube to the mould.

4. The combination claimed in claim 1, in which the body of refractory material abuts against the end wall of said second end portion and a sleeve forming part of said body projects into the bore of the tube.

5. The combination as claimed in claim 1 or 4 wherein the material of said refractory body is selected from the group consisting of silicon nitride and silicon carbide.

6. The combination claimed in claim 1 or 4 wherein said refractory body is a mixture of alumina and silica.

* * * * *